US006393982B2

(12) United States Patent
Simeth

(10) Patent No.: US 6,393,982 B2
(45) **Date of Patent: *May 28, 2002**

(54) MULTICOLOR SHEET-FED PRINTING PRESS

(75) Inventor: Claus Simeth, Geisenheim (DE)

(73) Assignee: MAN Roland Druckmaschinen AG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/230,306

(22) PCT Filed: Jul. 23, 1997

(86) PCT No.: PCT/EP97/03978

§ 371 (c)(1),
(2), (4) Date: Apr. 26, 1999

(87) PCT Pub. No.: WO98/03335

PCT Pub. Date: Jan. 29, 1998

(30) Foreign Application Priority Data

Jul. 24, 1996 (DE) ..... 196 29 822

(51) Int. Cl.[7] ..... B41F 5/16
(52) U.S. Cl. ..... 101/183; 101/217; 101/232
(58) Field of Search ..... 101/137, 142, 101/175, 177, 183, 217, 246, 171, 174, 212, 216, 232–234, 409, 490, 240; 270/58.01, 60; 271/3.19, 279, 298

(56) References Cited

U.S. PATENT DOCUMENTS

| | | | | | |
|---|---|---|---|---|---|
| 1,911,048 | A | * | 5/1933 | Adsit et al. | |
| 2,100,852 | A | * | 11/1937 | Jacobson | 101/137 |
| 2,297,846 | A | * | 10/1942 | Van Benschoten | 350/320 |
| 2,898,851 | A | * | 8/1959 | Peyrebrune | 101/136 |
| 2,909,117 | A | * | 10/1959 | Crissy | 101/137 |
| 2,911,907 | A | | 11/1959 | Davidson | |
| 2,981,181 | A | * | 4/1961 | Levien | 101/217 |
| 3,347,160 | A | | 10/1967 | Roozee | |
| 3,384,011 | A | | 5/1968 | Bolza-Schünemann | |
| 3,762,320 | A | * | 10/1973 | Johne et al. | 101/183 |
| 3,949,670 | A | * | 4/1976 | Katsuji | 101/177 |
| 4,188,883 | A | * | 2/1980 | Schone et al. | 101/183 |
| 4,370,926 | A | * | 2/1983 | Hattori | 101/207 |
| 4,777,876 | A | * | 10/1988 | Ishi | 101/177 |
| 5,353,703 | A | * | 10/1994 | Rieker | 101/177 |
| 5,469,787 | A | * | 11/1995 | Turner et al. | 101/211 |
| 5,579,691 | A | * | 12/1996 | Voge | 101/246 |
| 5,909,708 | A | * | 6/1999 | Bolza-Schunemann | 101/177 |

FOREIGN PATENT DOCUMENTS

| | | |
|---|---|---|
| DE | 438073 | 12/1926 |
| DE | 24 35 203 C2 | 10/1981 |
| DE | 34 19762 A1 | 11/1985 |
| WO | WO95/25015 | 9/1995 |

* cited by examiner

*Primary Examiner*—Eugene Eickholt
(74) *Attorney, Agent, or Firm*—Leydig, Voit & Mayer, Ltd.

(57) ABSTRACT

Multicolor prints should be economically producible in a printing machine suited for automation. For this purpose a printing machine is configured which operates according to the collect-run principle. The multicolor prints are collected on a rubber cylinder (21 on a printing cylinder (5). The printing machine is capable of processing two printing colors (inks) in one printing unit. For the execution of the collecting printing the sheets are fed in a cycle offset to the rotation of the collecting cylinder. There are yielded very compact and simply structured printing machine configurations.

10 Claims, 9 Drawing Sheets

MULTICOLOR SHEET-FED PRINTING PRESS

FIELD OF THE INVENTION

The invention relates to a sheet-fed rotary printing machine for multicolor printing.

BACKGROUND OF THE INVENTION

For the printing of small-format printing sheets it is a known practice to use printing units in which the cylinders participating in the printing, such as a plate cylinder, a rubber cylinder and a printing cylinder, have different diameters. Thereby mechanical expenditure can be saved in the field of the printing plates, of the rubber blankets or of the printing cylinder.

From DE-PS 24 35 203 there is known a sheet-fed rotary printing machine. It has, in the most diverse configurations, a plate cylinder with single or simple diameter, a rubber cylinder with multiple diameter and a printing cylinder with single diameter. Thereby from differently usable printing units from a particular plate cylinder a partial image of a print image can be printed on one of several segments of the rubber cylinder. Simultaneously this print image can be printed on a printing sheet guided on the printing cylinder, in which process the printing sheet with the printing cylinder revolves in correspondence to the movement of the segments of the rubber cylinder and is printed from this latter.

In U.S. Pat. No. 3,347,160 there is described an ink roller device for a multicolor rotary offset printing machine. This printing machine has a plate cylinder and a rubber cylinder in each case with multiple diameter to which there is allocated a printing cylinder with simple diameter. In the printing process the printing plate consisting of several image parts is generated on the plate cylinder from several cycled inking and moistening units, transferred to the multiply large rubber cylinder, and printed on a printing sheet guided on the printing cylinder. There the printing cylinder rotates a number of times corresponding to the diameter ratio between rubber cylinder and printing cylinder, until all the print image parts have been transferred onto the printing sheet. This multicolor printing machine is suited for the so-called proof printing.

What is disadvantageous in these devices is that even though they can be produced, to be sure, as individual printing units, the expenditure for the printing with images that contain more ink than the particular printing machine permits is very high. These printing machines, therefore, are suited only for special printing processes.

OBJECTS AND SUMMARY OF THE INVENTION

An object of the invention is to present a machine configuration which, with the simplest construction, has arbitrarily combinable printing mechanisms for the generating of prints with a different number of colors, renders unnecessary any changing of assemblies and is suited for high throughput with arbitrary edition levels.

Another object of the invention is to improve a device of the foregoing type, so that from standard elements there results a simple and therewith cheap printing machine which, by combining components of this type with one another, allow differently configurable multicolor printings, without it being necessary for the printing machine to be re-outfitted or to have too low a performance.

The present invention provides these and other advantages and overcomes the drawbacks of the prior art by providing a sheet-fed printing machine for printing sheets in a plurality of colors in which all the plate cylinders are provided with two printing plates and that in all the sheet conducting cylinders or drums there is only one gripper arrangement in operation. Here it is especially advantageous that, on the basis of standard printing machines, simplified forms of execution of printing machines are produced which with little expenditure permit economical printing processes, in which heed is given to a so-called "slim" or slender sheet running and the costs for building the machine are reduced because simple elements are used.

In the first place this can occur through the use of a printing cylinder with single diameter which rotates a number of times for the reception of the print images, while the other cylinders or drums provided with the same or with doubled diameter rotate only at half the speed of the printing cylinder.

In a further form of execution the rubber cylinder is constructed as a cylinder provided with single diameter. In standard printing processes proposed for this, it collects the prescribed print images of different colors on the plate cylinder and prints them in a single printing operation onto the printing sheets held on the printing cylinder.

These and other features and advantages of the invention will be more readily apparent upon reading the following description of preferred exemplary embodiments of the invention and upon reference to the drawings wherein:

DETAILED DESCRIPTION OF A PREFERRED EMBODIMENT

Figure 1:
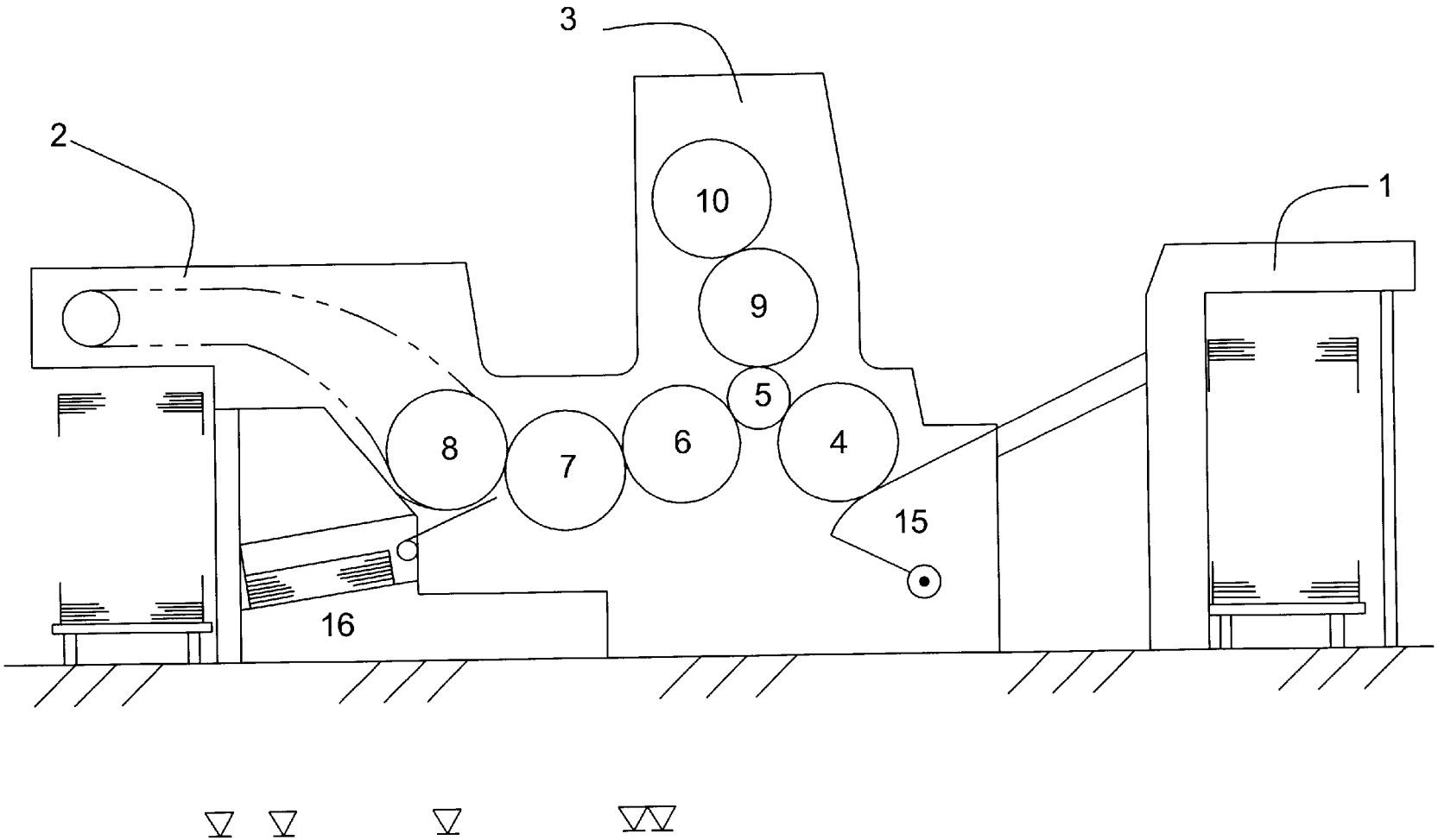
FIG. 1 is a schematic side elevation view of a two-color sheet printing machine with a printing cylinder with single or simple diameter.

In FIG. 1 there is represented a sheet-printing machine which comprises a feeder unit 1, a discharge or delivery unit 2 and a printing mechanism 3. The printing sheets are fed from the feeder unit 1 to the printing mechanism 3 and laid out in the discharge unit 2. For the sheet transport there is provided a feed drum 4 which transfers the printing sheet to a printing cylinder 5, from where the printing sheet is transported on further sheet-guide drums 6 and 7 to a discharge or delivery drum 8 and then deposited in the discharge unit 2. The feed drum 4, the sheet guide drums 6 and 7 and the discharge drum 8 have a so-called doubled diameter. The printing cylinder 5 has a single or simple diameter.

The diameter ratio relates to the length of a maximally-to-be-processed printing sheet. In the printing mechanism 3 there is arranged, further, a rubber cylinder 9 and a plate cylinder 10, which both have a doubled diameter.

The sheet-conducting cylinders or drums, insofar as they are provided with doubled diameter, can be equipped with one or two gripper rows for the transport of printing sheets.

In principle, however, it should hold for these and all the printing machines described in the following that a plate cylinder 10 is provided which is spannable with two printing plates. The sheet-conducting drums and cylinders should in principle, regardless of their diameter and the number of their working surfaces, be suited for the transport of a single printing sheet. This can be solved by the constructive restriction to only one gripper row or working surface or by control-technical equipment in the arrangement with several gripper rows or working surfaces.

Before the printing of a printing sheet, this sheet is fed by a pre-gripper 15 to the feed drum 4 and from there it is given over to the printing cylinder 5. The print images that are generated on a plate cylinder 10 with doubled diameter and two working surfaces, are transferred to a rubber cylinder 9 likewise with doubled diameter and two working surfaces, and printed during two revolutions of the printing cylinder 5 as two-color print on the printing sheet held there.

The sheet is guided there in a relatively stretched position and is pressed by depressing in a single gripper closure in a position in an exact register between the print images of the various printing inks. When there is a mention of print images, as a rule in the case of several print images, there are meant the different-colored partial images of a multicolor print. Only in the case of monochrome printing is this not the case.

On the other hand, with this printing machine a production process is also imaginable, in which only prints of a single color are generated. There it is possible to provide the image to be printed on the plate cylinder 10 once or twice. Therewith there can occur per revolution of the plate cylinder 10 in each case two prints or, per revolution of the printing cylinder 5 in each case one print. On the other hand, even if only a single image is provided, the control on the layer-on drum 4 can be provided in such manner that only with every other gripper row a sheet is taken off, and therewith a very simple monochrome printing machine results. Constructively this is also obtained when all the sheet-conducting cylinders or drums have only one working surface or only one gripper row. The alternative also shows that a printing machine operating with a half turn or one turn is generated, which generates one printed sheet either per printing cylinder revolution, or for every other revolution of the printing cylinder.

Figure 2:
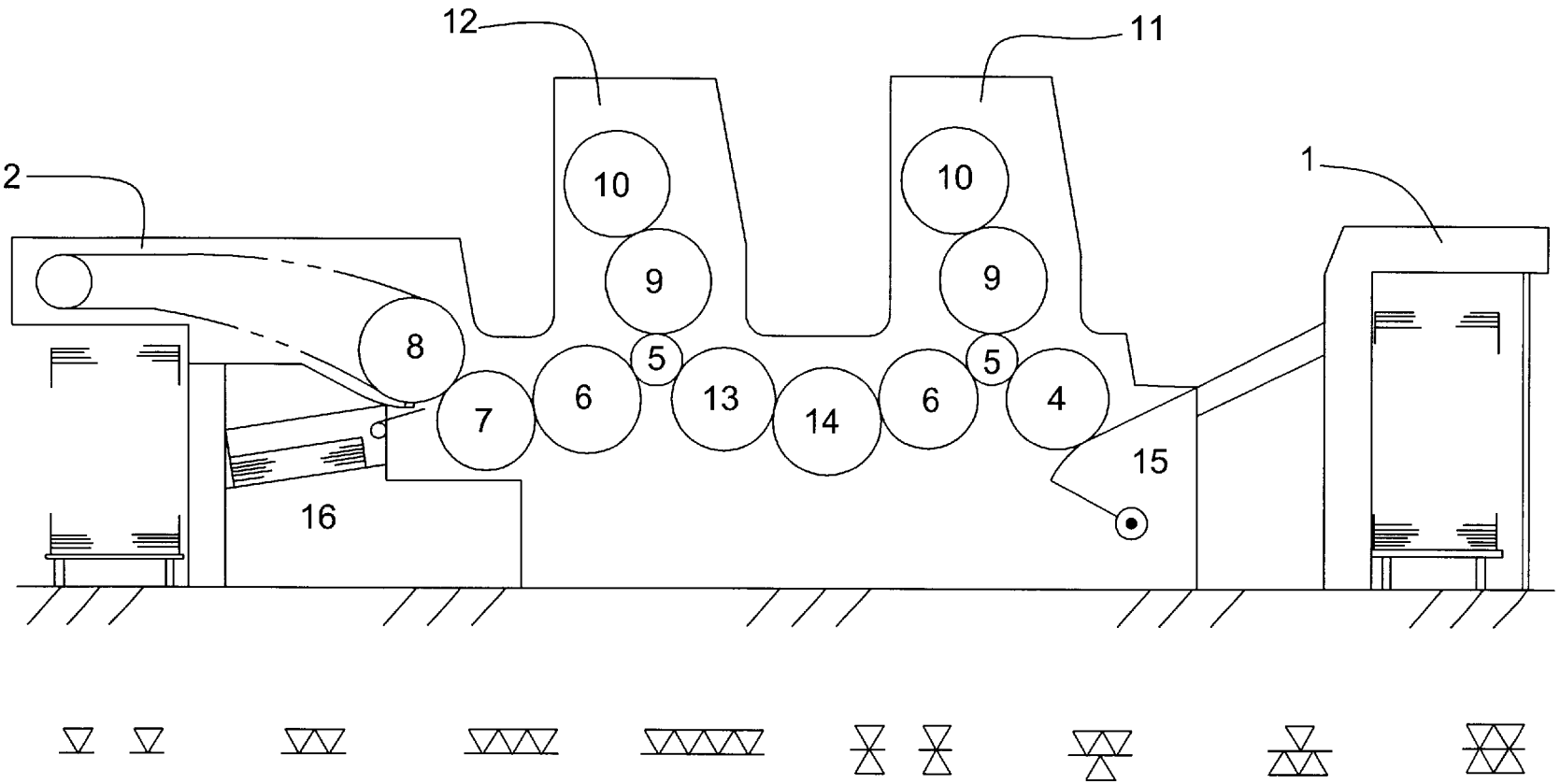
FIG. 2 is a schematic side elevation view of a four-color printing machine according to FIG. 1.

In FIG. 2 there is represented a printing machine of the configuration from FIG. 1, with two printing units. Between the feeder unit 1 and discharge unit 2 there are arranged the printing mechanisms 11 and 12. In configuration, they correspond to the printing mechanism seen in FIG. 1. They have in each case a plate cylinder 10, a rubber cylinder 9 and a printing cylinder 5, the printing cylinder 5 having half the diameter of the adjacent cylinders. From the printing cylinder the sheet is transferred in each case to a sheet guide drum 6. The graphic representation there also shows the correspondence between the fee drum 4 and a sheet guide drum 13. Further, the two printing mechanisms 11 and 12 are connected by a third sheet guide drum 14. Feed drum 4 and sheet guide drum 13 have only the distinction that the feed drum 4 cooperates with a pre-gripper arrangement 15.

With a printing machine of this form of construction, a multicolor printing machine can be combined simply from the basic components plate cylinder 10, rubber cylinder 9, printing cylinder 5, sheet guide drum 6 and sheet guide drum 13 or 4. The connection between the printing units 11, 12 is established by means of the sheet guide drum 14, which corresponds to the sheet guide drum 7, which also leads to the discharge unit 2. The printing machine is constructed from identical printing units and is very compact in the zone of the printing cylinder 5. Further, through the arrangement of two working surfaces on plate cylinder 10 and on rubber cylinder 9 with doubled diameter their handling is improved.

Thus it is possible to provide, on the plate cylinder 10, printing plates with one or two print images, so that different types of production are possible as under FIG. 1.

The printing machine in FIG. 2 makes it possible to bring in two colors with doubled throughput if in both printing units 11 and 12, in each case two print images are provided on the plate cylinders, which are arranged in like color. Further, it is possible to work in two colors with half throughput, if in each printing unit 11 and 12 on the respective plate cylinder 10 only one print image each is provided, which then have a different color.

There are yielded there further production possibilities from three-color to four-color printing. These production types run in the half-sheet-throughput mode.

Finally for small editions a double edition can also be run, as on each printing plate of the plate cylinder 10 another monochrome image is generated and on each printing sheet, in each case alternatively, the one and the other print image are printed. The different print sheets then can be deposited onto different stacks, for example, with the aid of an auxiliary discharge unit 16 and that of discharge unit 2. For this a control is required on the drum or cylinder allocated to the auxiliary discharge unit 16, which provides that every other printing sheet is sluiced out.

Furthermore, the sheet guide drums 6, 13, 14 can also be provided as a so-called turning device. They then have devices by means of which a printing sheet is taken off from the middle sheet guide drum 14 on its rear edge and is fed in inverted position and reversed transport direction to the next printing unit. Then the printing sheet is printed there on its reverse side. In this manner the printing machine is then capable of printing on two sides in one color, on one side in two colors and on the other in one color and on two sides in two colors. These principles are known.

The printing machine is, furthermore, extensible to many further printing units.

The printing machine according to FIGS. 1 and 2 have, further, as a special feature an additional auxiliary discharger 16. In this case, as needed, a proof sheet can be laid out or this position can be used as waste depository. The auxiliary discharge unit 16 is operated by delivery of a printing sheet from the discharge drum 8 by means of a flexible control arrangement in engagement with the grippers of the discharge drum 8.

Figure 3:
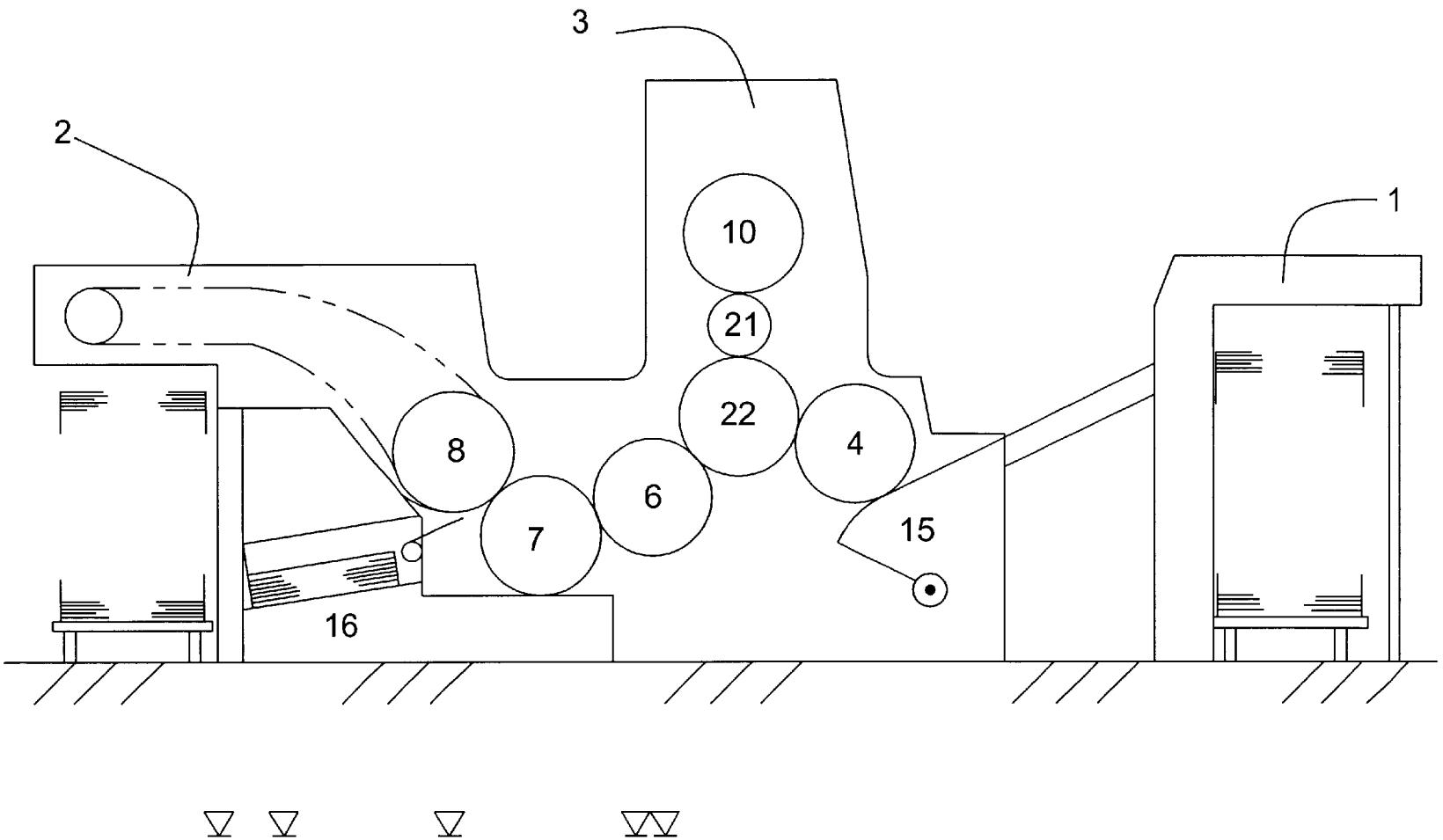
FIG. 3 is a schematic side elevation view of a four-color printing machine with a rubber cylinder with single diameter.

A further machine configuration is shown in FIG. 3. Between the feeder unit 1 and the discharge unit 2 there is arranged a printing unit 17, which as already known, has a feeder drum 4, a plate cylinder 10, a sheet guide drum 6, a sheet guide drum 7 and a discharge drum 8. Here, too, there is provided the auxiliary discharger 16, and the feeder drum 4 operates together with a pre-gripper system 15. Here there is provided a print cylinder 22 which has a doubled diameter, i.e. it has a circumference that corresponds to two format lengths. There it can have one or two working surfaces. It cooperates with a rubber cylinder 21 which has only a single diameter.

This printing machine operates, unless it is provided for monochrome printing, according to the so-called rubber collecting print process. This means that in the rotation of the rubber cylinder 21 two partial images provided on the plate cylinder 10 of a print image are superimposed on one another and are printed in common in a printing zone, on printing sheets that are held on the printing cylinder 22.

This configuration can also be expanded in such manner that to the printing cylinder 22 there can be allocated two printing units with a rubber cylinder 21 and a plate cylinder 10 in such manner that on every other revolution of the printing cylinder 22 a four-color print is generated. There, as is generally known, the printing zones of the rubber cylinders 21 with the printing cylinder 22 are laid so far apart that the first printing is completed before the second printing begins.

In a printing machine of this construction type various printing processes are conceivable. For one, on each rotation of the rubber cylinder 21 a monochrome image can be printed on printing sheets that are held on the printing cylinder 22. There, on the printing cylinder 22 there must be provided a series of two working surfaces and two gripper rows, which are loaded with individually with a printing sheet on each revolution. On the plate cylinder 10, then, there must be provided two like print images for a single printing color.

The production manner for a single print image on the plate cylinder 10 is possible with simply occupied sheet-guiding drums or cylinders with full throughput, i.e. with one printing sheet per revolution. It can also be provided, however, that on a doubly occupied printing cylinder 22 with two working surfaces only every other gripper row is loaded with a printing sheet and thus also only on every other revolution of the rubber cylinder 21 there is generated a print image in the print zone between rubber cylinder 21 and printing cylinder 22.

Finally, as described earlier, on the plate cylinder 10 it can be arranged to provide two differently colored partial images of a single print image. There on the rotation of the rubber cylinder 21 first the one print image is transferred to the rubber blanket and then the second print image is superimposed onto this. The print images now superimposed on one another are then printed in common in the print zone between the rubber cylinder 21 and the print cylinder 22 on the printing sheet supported there. Thus, on each revolution of the rubber cylinder 21, a two-color print can be generated, in which process the printing machine is driven with half throughput, i.e. with loading of every other gripper row on feed drum 4 or printing cylinder 22 with a printing sheet. This obviously holds only if the printing machine, on the sheet-conducting cylinders, is not occupied with only one working surface and (one) gripper row.

Figure 4:
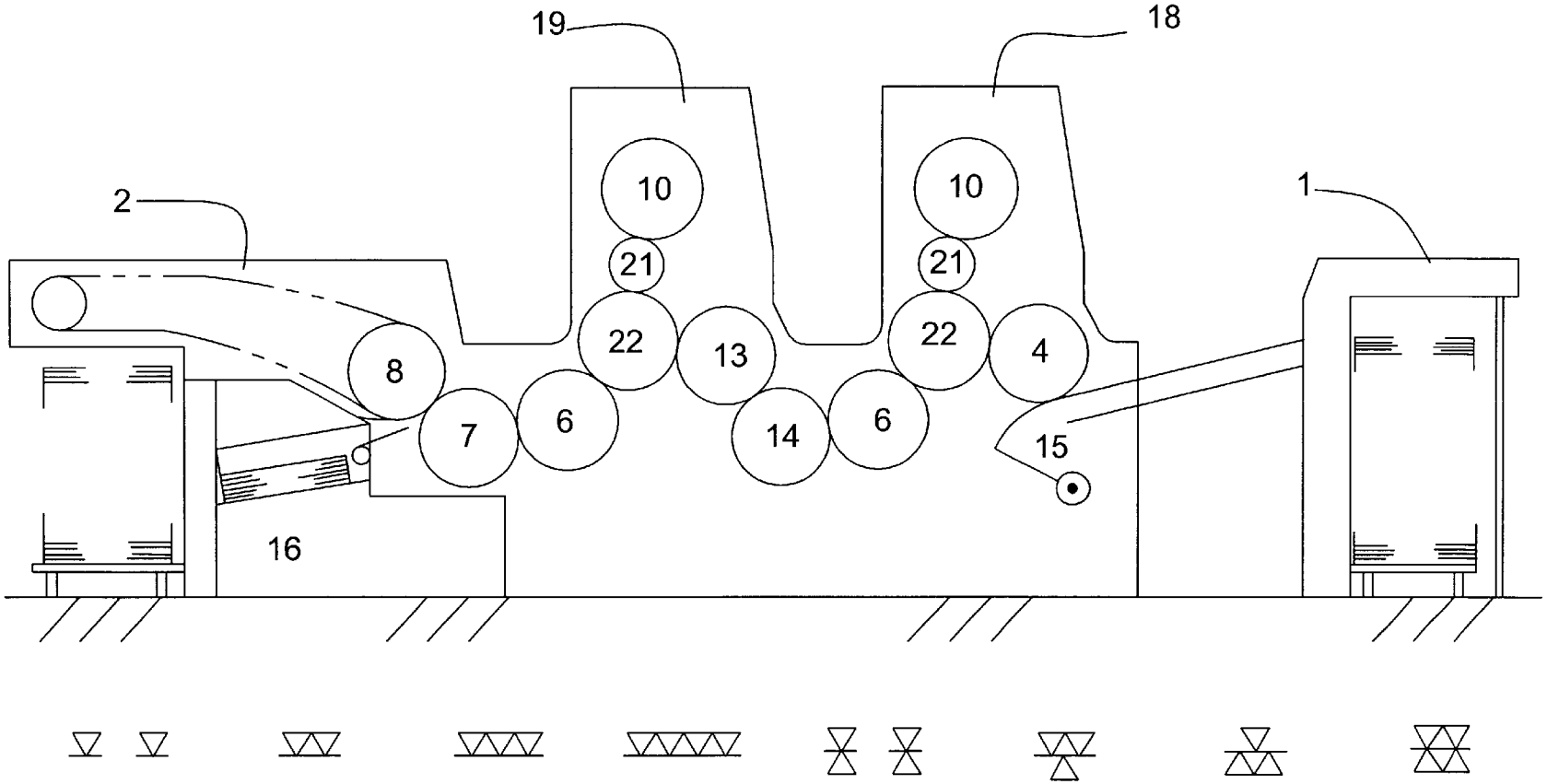
FIG. 4 is a schematic side elevation view of a four-color printing machine according to FIG. 3.

In FIG. 4 there is provided a corresponding printing machine according to FIG. 3 with several printing units. Between the feeder unit 1 and discharge unit 2 there are provided two printing units 18 and 19. These are configured alike in correspondence to FIG. 2. There, both have a plate cylinder 10, a rubber cylinder 21, a printing cylinder 22 and a sheet guide drum 6.

In a corresponding manner the feed drum 4 and a sheet guide drum 13 are allocated to the printing cylinder 22, in which case only the feed drum 4 operates with a pre-gripper system 15. Finally, both printing units are connected with a sheet guide drum 14, which, however, corresponds to the sheet guide drum 7 and which again leads to the discharge drum 8. The configuration of the printing machine permits the printing of up to four-color prints with different throughputs in printing sheets.

Fundamentally also this machine again operates according to the rubber-collecting printing process like that from FIG. 3. Therewith in printing units 18 and 19 there can in each case be generated a two-color print, in which the two prints can supplement each other so that altogether a four-color print results. This four-color print, after a proof phase, is generated in each case with altogether two revolutions of the rubber cylinders 21 of both printing units.

Further, however, on the plate cylinder 10 there can be provided only one monochrome image; then this printing machine would print in two colors and only on every other revolution of the rubber cylinder 21 would it generate a print sheet, that is to say one printing sheet printed in two colors for each revolution of a printing cylinder 22.

Finally it can also be provided to print on each plate cylinder 10 with two print images, so that in each revolution of the rubber cylinder 21 a print image can also be transferred to the printing cylinder 22. Then again, with the full throughput on the printing cylinder, the work is done with two printing sheets per revolution, which then, however, are printed with one color in the first printing unit and with a second color in the second (unit).

This printing machine, too, is provided with an auxiliary discharge unit 16.

In this machine also it is possible to install a turning arrangement and thereby to create the possibility for two-sided printing in different configurations as described further above. Finally, in FIGS. 5 and 6 there is represented a further configuration of the printing machine according to FIG. 3. It, too, has between the feeder unit 1 and discharge unit 2 a printing mechanism 20, in which there are provided a plate cylinder 10, a printing cylinder 22, a feed drum 4 and a sheet guide drum 6. Between plate cylinder 10 and printing cylinder 22 there is provided a rubber cylinder 21 which has a single diameter. The basic configuration corresponds to that in FIG. 3. Therewith, therefore, monochrome or two-color prints can be generated in different throughputs. Further, to the sheet guide drum 6 there is allocated a further printing unit. This printing unit consists of an inking mechanism 24 which is slidably arranged, a plate cylinder 25 and a rubber cylinder 26. The plate cylinder 25 and the rubber cylinder 26 are provided only with single diameter and are thus recognizably suited only for the applying of a single print image color. What is essential is the arrangement of the rubber cylinder 26 on the underside of the sheet guide drum 6, which here takes over the function of a printing cylinder. Since the printing sheet, after it was printed on the upper side between rubber cylinder 21 and printing cylinder 22, now is in contact with the sheet guide drum 6 with its printed side, its reverse side lies opposite the rubber cylinder 26 and can be printed from there. Therewith it is possible to generate, in this printing machine, a two-color printing on the one side to be completed with a further print image on the other side of the printing sheet. Furthermore, a monochrome print can also be generated on both sides.

Figure 5:
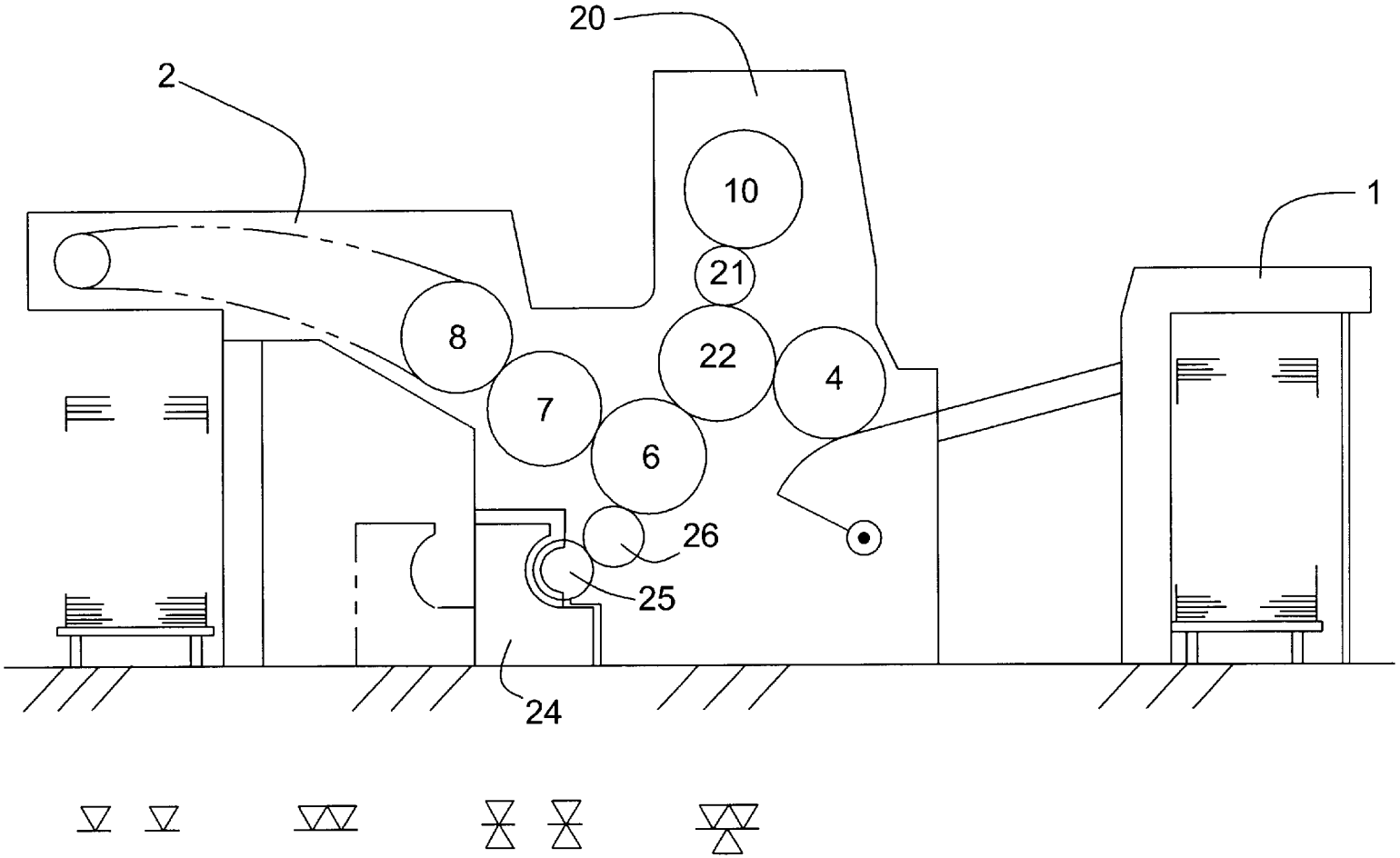
FIG. 5 is a schematic side elevation view of a three-color printing machine with rubber cylinders with simple diameter and a perfecting printing mechanism.
Figure 6:
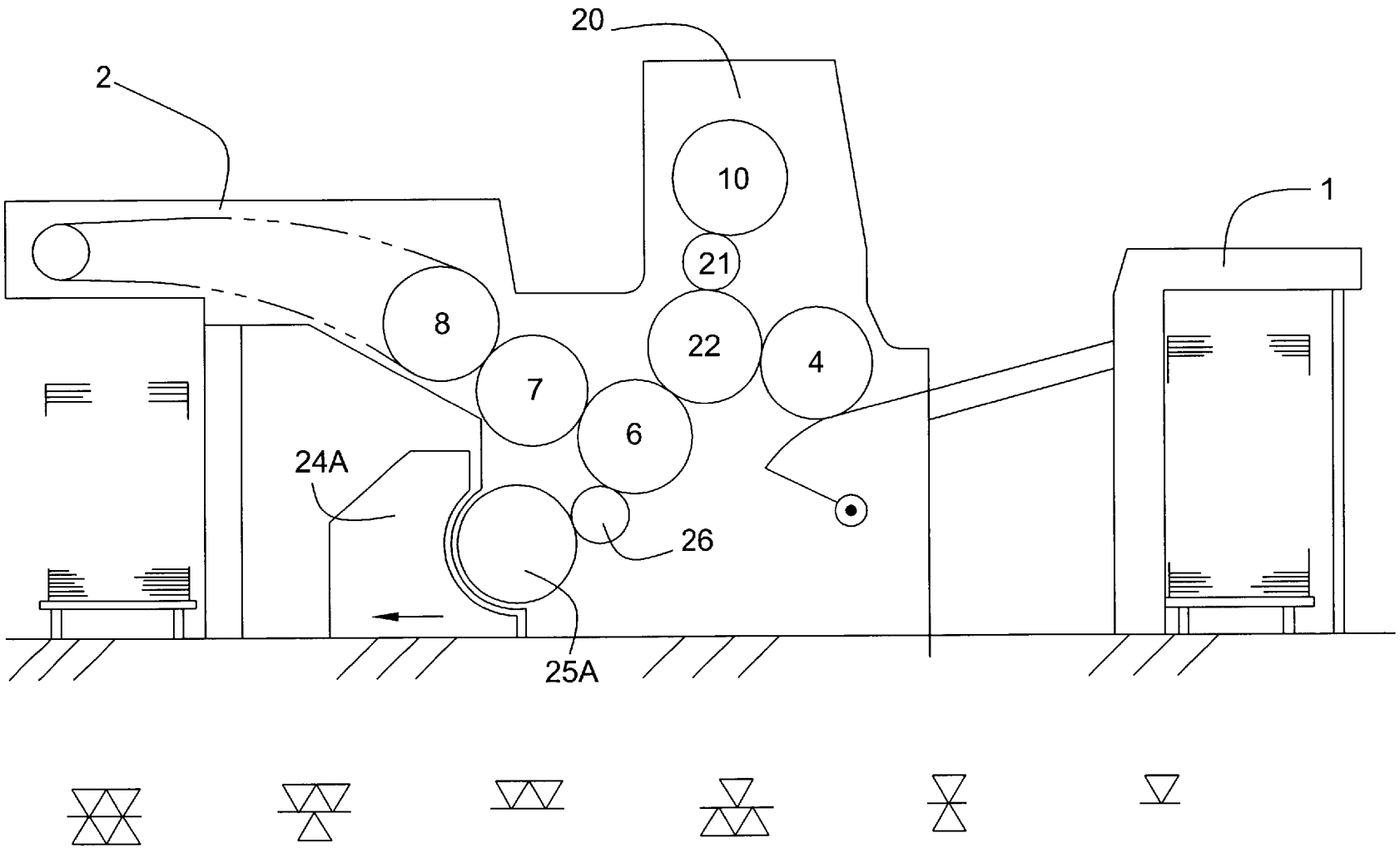
FIG. 6 is a schematic side elevation view of a four-color printing machine with rubber cylinders with single diameter and a perfecting printing mechanism.

In FIG. 6 there is represented a configuration similar to that in FIG. 5. Here, to be sure, as a perfecting printing mechanism a plate cylinder 25A with doubled diameter is to be combined with a rubber cylinder 26 with single diameter, so that here also the perfecting printing proceeds according to the rubber collecting principle. The printing machine is therefore capable of operating 2/1-color with half throughput, as well as 2/2-color with half throughput. To the plate cylinder 25A there is allocated for this purpose an inking mechanism 24A drivable in a known manner. This inking mechanism 24A contains two inking arrangements and possibly also two moistening arrangements, which are cyclically switchable top that they are capable of applying either one, or two, colors to the plate cylinder 25A. In the machines according to FIGS. 5 and 6 no sheet turning is required.

It is important for the execution of the production manners described that the inking mechanisms or the inking-and-moistening moistening mechanisms are to be formed flexible; this, however is known from the state of the art. According to this each inking mechanism must, for each cylinder revolution, be switchable on and off or settable on and off. To this end, in the case of a plate cylinder with doubled diameter and two images lying in succession, there may be provided an arrangement of two inking mechanisms 40,42 (shown in FIG. 7) lying in succession, which are activated individually and thus can ink the print images differently. Further, it should be possible to ink the two print images thoroughly with a single color, and to moisten them. For this only one inking or inking-and-moistening mechanism is set in continuous operation.

Further, possibly in the application of two printing inks, the operation should be performed only with one moistening mechanism. For this, one moistening mechanism is shut off and the other one is set in continuous operation. Moreover, the printing machine can also be provided only with a single moistening mechanism per printing unit.

With these arrangements and construction means known in themselves for the control of inking and moistening mechanisms the operation with all the printing machines described is possible in the different manners of production specified.

Figure 7:
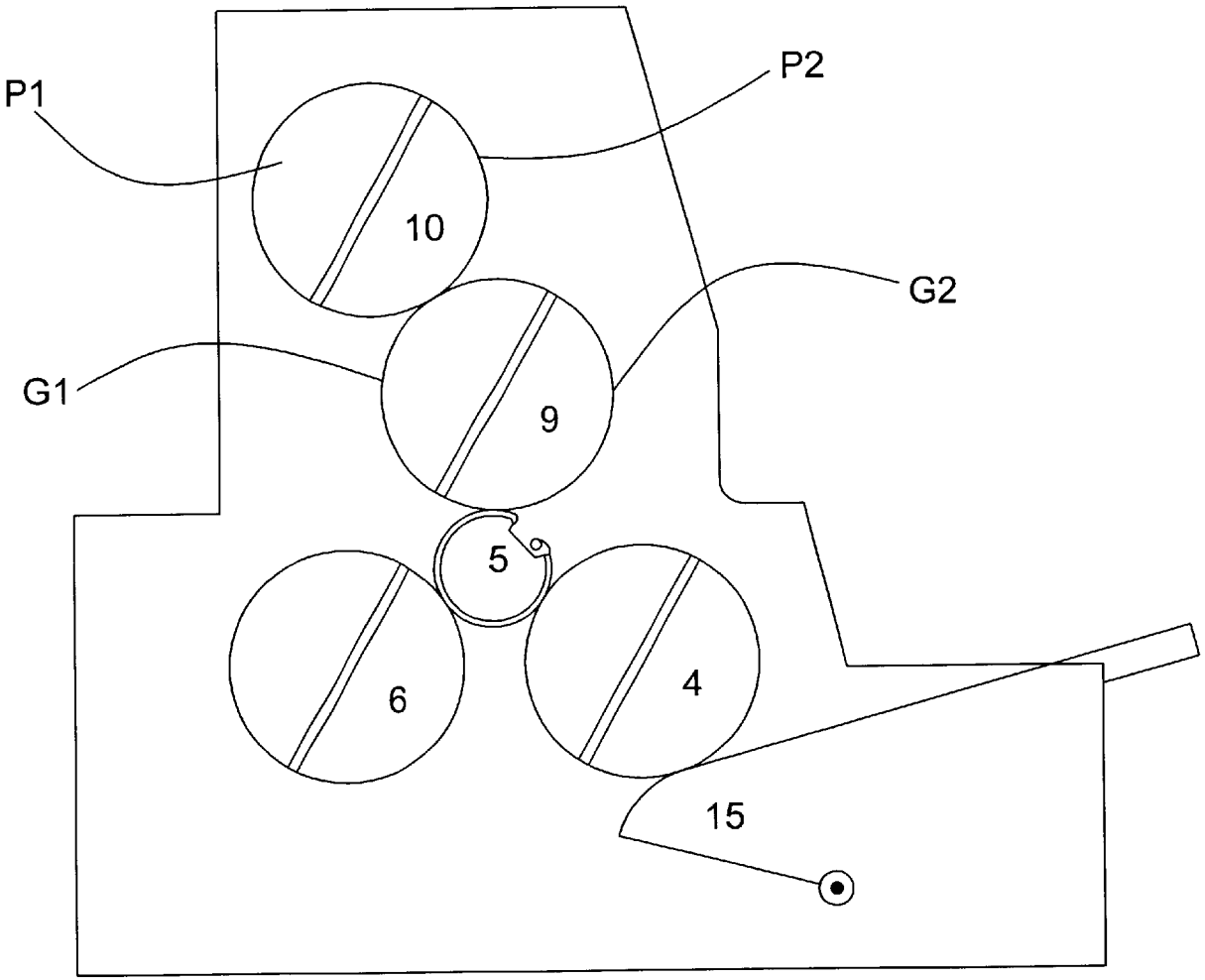
FIG. 7 is a schematic side elevation view of a printing unit with a printing cylinder with single diameter.

In FIG. 7 a printing mechanism according to the inventive principle is represented in a larger scale. With the aid of this figure the mode of functioning of the earlier-described printing machines can be theoretically explained. The plate cylinder 10 is provided with doubled diameter, and is occupied with two printing plates P1 and P2. The rubber cylinder 9 also is provided with doubled diameter and with two rubber blanket sections G1 and G2. The sheet-conducting drums 4 and 6 also are provided with doubled diameter. The division of the corresponding cylinder indicated in FIG. 7 is to be related only to the occupation of the parts with working surfaces such as printing plates, rubber blankets or sheet guide surfaces, not, however, to their rotary position to one another. Obviously the cylinders are coupled with one another in such manner that the print images are printed in exact register to one another and on the printing sheet.

The printing cylinder 5 is provided exclusively with a single diameter. It can, however, also provided with doubled or with triple diameter.

To the feed drum 4 a print sheet is fed from a pre-gripper 15 and then conducted onward to the printing cylinder 5. In the printing the sheet feed is attuned so that there is taken into account the pre-run required on the plate cylinder 10 and the rubber cylinder 9 for the inking of the printing plates P1, P2 and of the corresponding sides of the rubber blankets G1, G2. There the printing machine first executes an empty revolution during which the first printing plate P1 is inked. When this reaches the first rubber blanket section G1 the second printing plate P2 is inked and the printing cylinder 5 revolves idly, since on the second rubber blanket section G2 there is not yet any print image present. Now the sheet feed must begin, since in the half revolution the first print image on the rubber cylinder 9 reaches the printing cylinder 5. This is a half-turn of the feed drum 4 away from the sheet onlay. Thus the first printing sheet reaches the printing cylinder 5 when the rubber cylinder 9 readies the first print image or the first color of the print image. In the next half revolution of the printing machine again no printing sheet is fed in, since then the printing sheet makes a second revolution on the printing cylinder, there to take off the second print image from the rubber cylinder 9. After this a printing sheet again is fed in, and so forth. The feed drum 4 is executed accordingly as a half-occupied cylinder; i.e. only one half of the feed drum 4 is provided with a sheet-guiding surface and a corresponding gripper system. In the case of a doubly occupied feed drum 4 with two gripper rows, for the normal manner of operation the second row of grippers is to be inactivated.

The same principle holds also for printing machines with single-sized rubber cylinder corresponding to FIGS. 3, 4, 5 and 6. There also the completed two-color print images must be always first be transferred to the rubber cylinder 9 before they can be printed in one passage on the printing sheet held on the print cylinder 5. To assure that no printing ink passes onto a sheet-conducting surface of the printing cylinder 5, it is advantageous to execute the printing cylinder 5 half-occupied, so that in the taking up of the second print image no printing surface stands opposite the rubber cylinder 9. Likewise also a spoiled sheet can be sent ahead, in order to avoid any soiling. In the printing of the collected print image simultaneously the first print image again is applied from the plate cylinder 10 onto the rubber cylinder 9.

Figure 8:
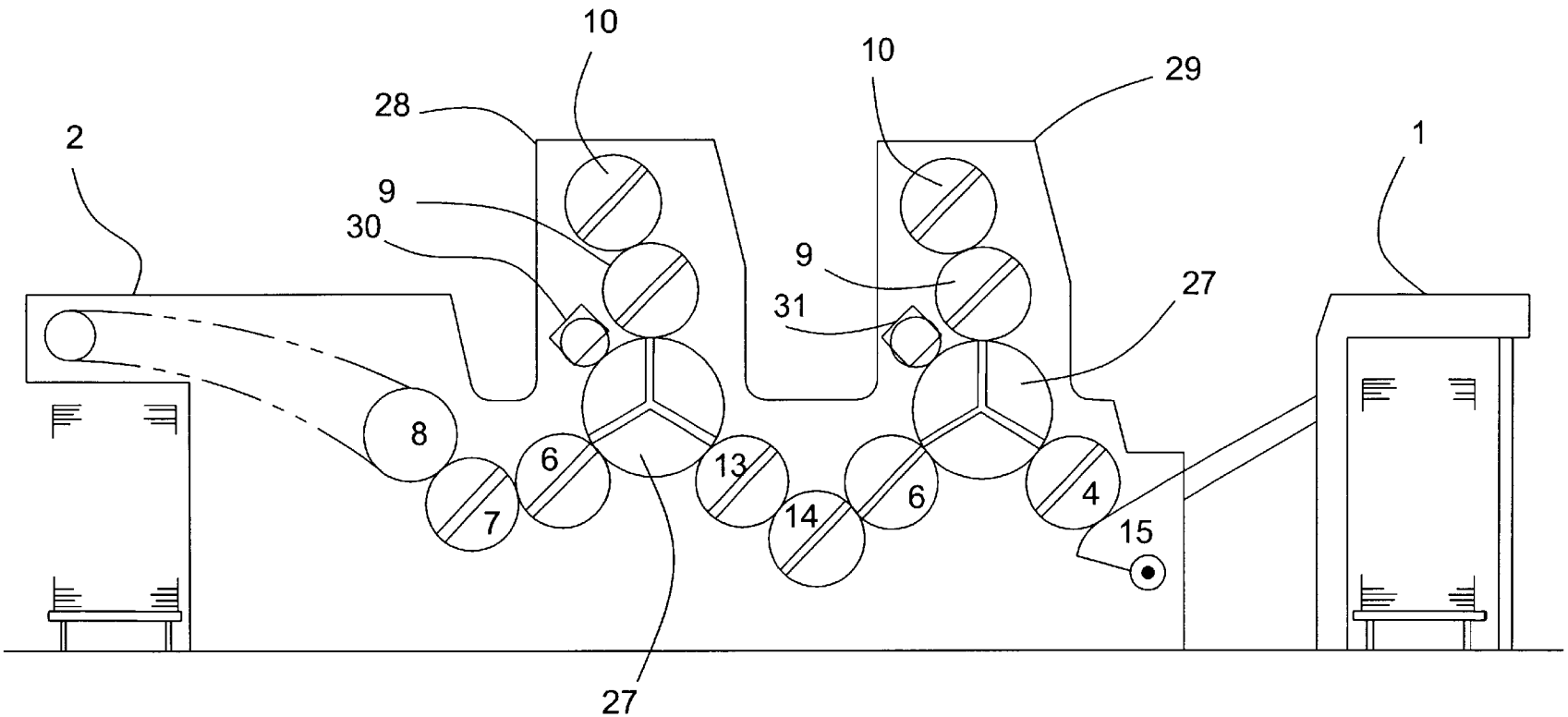
FIG. 8 is a schematic side elevation view of a four-color printing machine having printing cylinders with triple diameters.

The printing proceeds in like manner in a printing machine with printing units 28, 29 according to FIG. 8. Here print cylinders 27 are constructed as triple-sized cylinders. However, as in the configuration according to FIG. 7 they collect the print images in each case in pairs from the rubber cylinder 9. For this reason, here, too, the printing sheets revolve twice with the printing cylinders 27 and the cycling of the sheet feed is executed in correspondence to that described earlier. The more slender sheet conduction is advantageous here, i.e. the printing sheets are not so severely curved. This is desirable especially in cardboard processing.

Furthermore, the printing cylinder 27 is occupied with printing sheets on all working surfaces. With this machine, to be sure, for this reason an advance sheet as soiled sheet is required, since otherwise a printing surface of the printing cylinder would run through empty on the rubber cylinder 5. This sheet receives consequently only the imprint of one color and must be separated out.

In the configuration according to FIG. 8 it is further advantageous that further-processing arrangements 30, 31 on the larger printing cylinders 27 can be engaged directly after the printing units 28, 29. As further-processing arrangements 30, 31 there come in question lacquering mechanisms, numbering mechanisms, imprint mechanisms, stamping, punching, perforating, cutting and grooving devices. In like manner there can also be provided in this place an arrangement for inline quality control.

In the above-mentioned printing units that operate according to the printing cylinder-collecting principle it is also possible to span the printing cylinder or parts of its surface with a rubber blanket. Then, in an intermediate beat one of the two print images, which, to be sure, it must bring up mirror-reversed, can be transferred from the rubber cylinder to the printing cylinder. In the printing then one print image is transferred from the rubber cylinder to the printing sheet and the other from the printing cylinder onto the reverse side of the printing sheet. From this there is yielded a two-side inked print.

Figure 9:
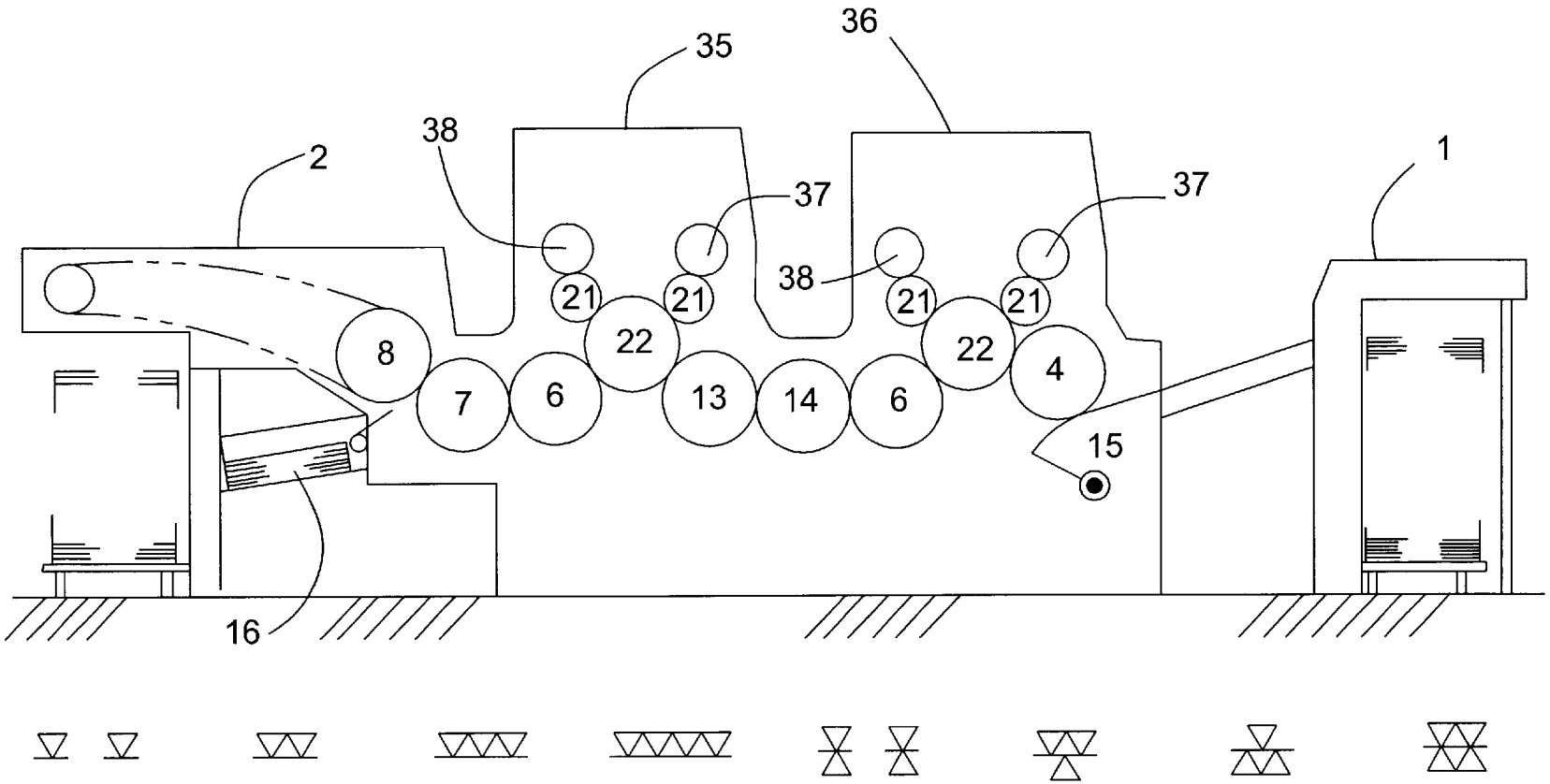
FIG. 9 is a schematic side elevation view of a multicolor printing machine with two double-printing units and printing cylinders with doubled diameter.

In FIG. 9 there is shown a four-color printing machine with two double printing units 35, 36. The printing units 35, 36 have as special feature the allocation of plate cylinders 37, 38 with single diameter. Therewith on each printing cylinder 22 there likewise come to be printed two print images in common. Each rubber cylinder 21 transfers, to be sure, only one print image.

The printing mechanisms 35, 36 allocated to the printing cylinders 22 consist in the example represented therefore of plate cylinders 37, 38 with single diameter and rubber cylinders 21 with single diameter. The printing occurs then in one passage on the printing cylinder 22, in which the printing zones lie so far apart that the first printing is concluded before the second begins. The printing cylinder 22 has either one working surface and one gripper row or two working surfaces and two gripper rows, in which one gripper row is drivable for the printing.

These configurations can be varied, as already described under FIG. 3, as plate cylinder with doubled diameter can be allocated in each case to the rubber cylinders 21. Then there can be generated a four-color print per printing passage, in which again two print images per rubber cylinder 21 are collected. Then the machine shown is suited for eight-color printing.

The principle of multicolor printing described is not abandoned either in the arraying on one another of several printing units of the construction type described. The control of the printing machine in starting, or after the passage of the last printing sheet, is analogously the same, in which it is always ensured that no printing ink can pass onto printing material-conducting surfaces. Here, on running-out of the printing assignment a cylinder-setting device can be used in a known manner which makes it possible to disengage the rubber cylinder first from the plate cylinder and then also from the printing cylinder.

As printing processes in such described printing machines there can be used both the conventional offset printing, and also the indirect intaglio printing or relief printing or also the so-called dry offset printing or waterless offset printing. Likewise different printing processes can be combined with one another, so that different working processes are usable simultaneously, in order, for example, to process special inks and lacquers after the printing.

The printing machines are conceived in the simplest possible forms of execution and are especially suited for undertaking automation measures on the plate cylinder. Here the great diameter of the plate cylinder 10 is important. It is thus easily possible to connect numerous image-making arrangements, as feed arrangements of imaged printing forms. Likewise it is easily possible to connect feed arrangements for printing form raw material inside the plate cylinder 10. The printing plates can be both divided and also combined. This is dependent only on the production expenditure. The arrangements mentioned are not described in detail here, since they are known and were not an object of the invention.

What is claimed is:

1. A sheet-fed printing machine for printing sheets in a plurality of colors utilizing an indirect printing process, the printing machine comprising, in combination:

a sheet-feeding unit, a plurality of printing units each of which includes a plate cylinder having a plurality of printing plates mounted thereon capable of transferring two differently colored partial images of a multicolor print image, a plurality of inking mechanisms which can be brought into and out of operative engagement with the plurality of plate cylinders on each revolution of the plate cylinder, and a rubber cylinder having a diameter corresponding to twice the multicolor print image length and two working surfaces, and a printing cylinder which together with the rubber cylinder defines a printing zone, wherein each sheet is conducted two times through the printing zone by the printing cylinder in order to print the multicolor print image on the sheet, a plurality of sheet-guiding cylinders each of which is configured to transport only a single sheet at a time, said plurality of sheet-guiding cylinders including at least one sheet transfer cylinder having a diameter corresponding to twice the multicolor print image length arranged between each adjacent pair of printing units, an auxiliary discharge unit for receiving sheets printed with only a partial print image, wherein said plurality of sheet guiding cylinders includes a discharge cylinder which is arranged to feed sheets with only a partial print image to said auxiliary discharge unit, and a main discharge unit for receiving sheets printed with the multicolor print image.

2. The printing machine according to claim 1 wherein the printing cylinder has a diameter corresponding to a single print image length.

3. The printing machine according to claim 1 wherein each of the sheet-guiding cylinders is provided with only one gripper row.

4. The printing machine according to claim 1 wherein the sheet-feeding unit is controllable such that a sheet is not fed into the printing zone when print images are being collected on the rubber cylinder.

5. The printing machine according to claim 1 wherein the sheet-feeding unit is controllable such that a sheet is not fed into the printing zone when the print images are being transferred from the rubber cylinder to a sheet held on the printing cylinder.

6. The printing machine according to claim 1 wherein the sheet-feeding unit includes a feed drum which has a diameter corresponding to twice the print image length and includes only one gripper row.

7. The printing machine according to claim 1 wherein each of the sheet-guiding cylinders includes two gripper rows with only one gripper row being operable for guiding sheets.

8. The printing machine according to claim 1 wherein the printing machine is configured for offset printing.

9. The printing machine according to claim 1 wherein the printing machine is configured for indirect intaglio printing.

10. The printing machine according to claim 1 wherein the printing machine is configured for indirect raised printing.

* * * * *